US011227473B1

(12) United States Patent
Griffith et al.

(10) Patent No.: US 11,227,473 B1
(45) Date of Patent: Jan. 18, 2022

(54) SELF-TESTING HAZARD SENSING DEVICE

(71) Applicant: Honeywell International Inc., Charlotte, NC (US)

(72) Inventors: Bruce R. Griffith, Geneva, IL (US); Dale Johnson, Elgin, IL (US); Christopher Dearden, Melton Mowbray (GB); Michael Barson, Nuneaton (GB); Benjamin Wolf, Charlotte, NC (US)

(73) Assignee: Honeywell International Inc., Charlotte, NC (US)

( * ) Notice: Subject to any disclaimer, the term of this patent is extended or adjusted under 35 U.S.C. 154(b) by 0 days.

(21) Appl. No.: 17/018,734

(22) Filed: Sep. 11, 2020

(51) Int. Cl.
*G08B 29/14* (2006.01)
*G08B 17/107* (2006.01)
*G08B 17/117* (2006.01)

(52) U.S. Cl.
CPC ..... *G08B 17/107* (2013.01); *G08B 17/117* (2013.01); *G08B 29/145* (2013.01)

(58) Field of Classification Search
CPC ..... G08B 29/04; G08B 29/043; G08B 29/12; G08B 29/145
See application file for complete search history.

(56) References Cited

U.S. PATENT DOCUMENTS 5,523,744 A * 6/1996 Wieser ..... G08B 29/145 340/630
5,644,071 A * 7/1997 Wagner ..... G08B 29/145 73/1.01
5,936,533 A 8/1999 Bernal et al.
7,934,411 B2 5/2011 Koch
8,121,465 B2 2/2012 Koch
8,910,640 B2 12/2014 Sears et al.
8,933,811 B2 1/2015 Højmose
9,659,485 B2 5/2017 Piccolo, III
9,814,263 B2 11/2017 Cochand et al.
9,844,234 B2 12/2017 Thorens et al.
9,959,748 B2 5/2018 Moffa
11,024,154 B1 6/2021 Lang et al.
11,127,284 B1 9/2021 Barson et al.
2009/0308134 A1* 12/2009 Pepper ..... G08B 29/12 73/1.06
2015/0310732 A1* 10/2015 Piccolo, III ..... G08B 29/145 340/515
2018/0028993 A1 2/2018 Dubief
(Continued)

FOREIGN PATENT DOCUMENTS

DE 20215640 U1 2/2003
GB 2176600 A 12/1986
(Continued)

*Primary Examiner* — Andrew W Bee
(74) *Attorney, Agent, or Firm* — Brooks, Cameron & Huebsch, PLLC

(57) ABSTRACT

Devices, methods, and systems for a self-testing hazard sensing device are described herein. One device includes a sensor, a wire dipped in a material, a controller configured to provide a current to the wire to heat the material and generate aerosol and/or carbon monoxide, and an airflow generator configured to provide the aerosol and/or carbon monoxide to the sensor. The controller configured to determine whether the self-testing hazard sensing device is functioning properly using the aerosol and/or carbon monoxide provided to the sensor.

20 Claims, 6 Drawing Sheets

(56) References Cited

U.S. PATENT DOCUMENTS

| | | | | |
|---|---|---|---|---|
| 2018/0293878 | A1* | 10/2018 | Penney | B05B 17/0646 |
| 2019/0378402 | A1* | 12/2019 | Bouchard | G08B 17/107 |
| 2020/0035088 | A1* | 1/2020 | Penney | G08B 29/145 |
| 2020/0250963 | A1 | 8/2020 | Rodriguez | |
| 2020/0402381 | A1* | 12/2020 | Nelson | F21V 15/01 |
| 2021/0065536 | A1 | 3/2021 | Dearden et al. | |

FOREIGN PATENT DOCUMENTS

| | | | |
|---|---|---|---|
| GB | 2459322 | A | 10/2009 |
| WO | 0227293 | A2 | 4/2002 |

* cited by examiner

SELF-TESTING HAZARD SENSING DEVICE

TECHNICAL FIELD

The present disclosure relates generally to devices, methods, and systems for a self-testing hazard sensing device.

BACKGROUND

Large facilities (e.g., buildings), such as commercial facilities, office buildings, hospitals, and the like, may have a fire alarm system that can be triggered during an emergency situation (e.g., a fire) to warn occupants to evacuate. For example, a fire alarm system may include a fire control panel and a plurality of hazard (e.g., fire) sensing devices (e.g., smoke detectors), located throughout the facility (e.g., on different floors and/or in different rooms of the facility) that can sense a fire occurring in the facility and provide a notification of the fire to the occupants of the facility via alarms.

Maintaining the fire alarm system can include regular testing of fire sensing devices mandated by codes of practice in an attempt to ensure that the fire sensing devices are functioning properly. However, since tests are completed manually, there is a risk that faulty fire sensing devices may be missed and go untested.

A typical test includes a maintenance engineer using pressurized aerosol to force synthetic smoke into a chamber of a fire sensing device, which can saturate the chamber. In some examples, the maintenance engineer can also use a heat gun to raise the temperature of a heat sensor in a fire sensing device and/or a gas generator to expel carbon monoxide (CO) gas into a fire sensing device. These tests may not accurately mimic the characteristics of a fire and as such, these tests often fail to accurately determine the ability of a hazard sensing device to detect an actual hazard within required timeframes.

Also, this process of manually testing each fire sensing device can be time consuming, expensive, and disruptive to a business. For example, a maintenance engineer is often required to access fire sensing devices which are situated in areas occupied by building users or parts of buildings that are often difficult to access (e.g., elevator shafts, high ceilings, ceiling voids, etc.). As such, the maintenance engineer may take several days and several visits, often out of hours, to complete testing of the fire sensing devices, particularly at a large site. Additionally, it is often the case that many fire sensing devices never get tested because of access issues.

DETAILED DESCRIPTION

Figure 1A:
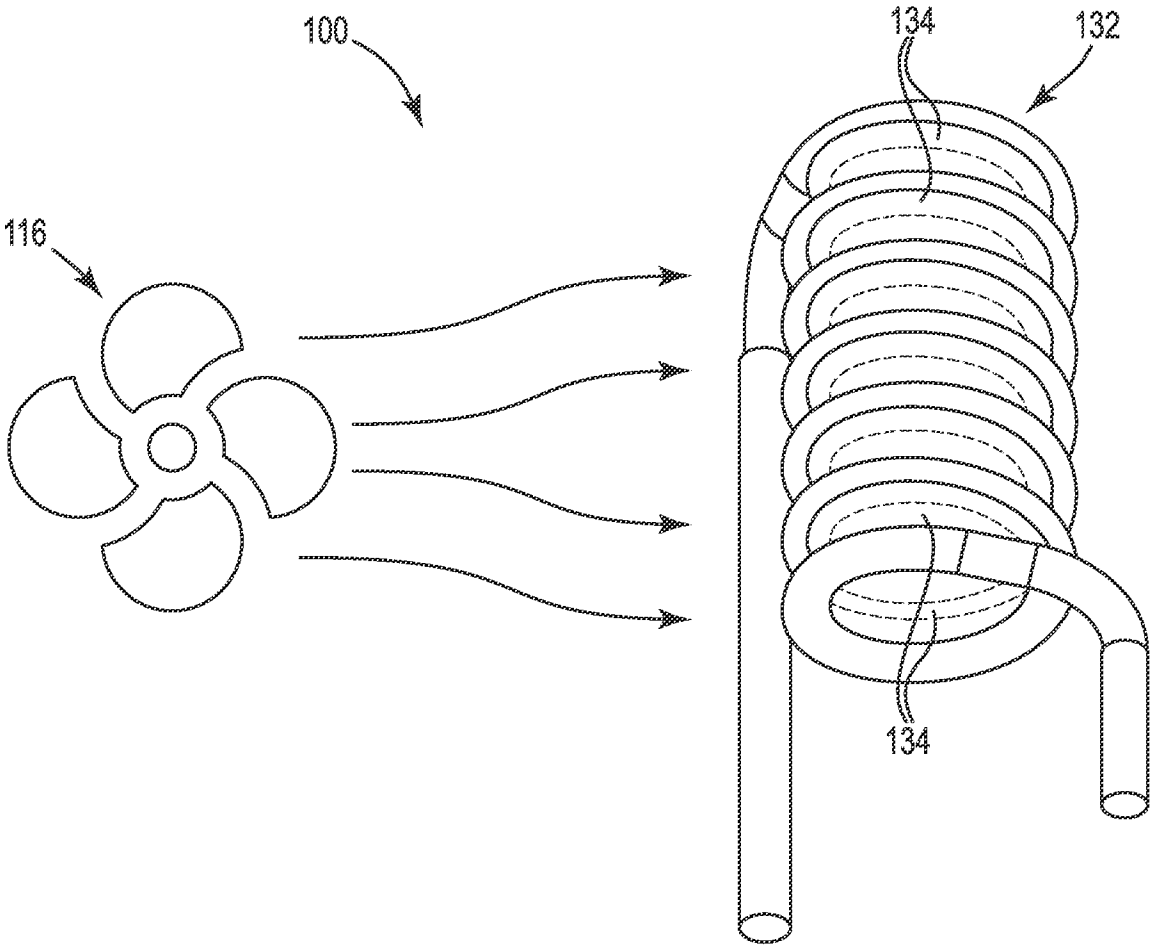
FIGS. 1A-1B illustrate a portion of a self-testing hazard sensing device in accordance with an embodiment of the present disclosure.

Devices, methods, and systems for a self-testing hazard sensing device are described herein. One device includes a sensor, a wire dipped in a material, a controller configured to provide a current to the wire to heat the material and generate aerosol and/or carbon monoxide, and an airflow generator configured to provide the aerosol and/or carbon monoxide to the sensor. The material can be a solid material at room temperature that can melt at temperatures greater than 70 degrees Celsius. The controller is configured to determine whether the self-testing hazard sensing device is functioning properly using the aerosol and/or carbon monoxide provided to the sensor.

In contrast to previous hazard (e.g., fire) sensing devices in which a maintenance engineer would have to manually test and/or recalibrate each fire sensing device in a facility (e.g., using pressurized aerosol, a heat gun, a gas generator, or some combination thereof) to determine whether maintenance or recalibration of the device is required, hazard (e.g., fire) sensing devices in accordance with the present disclosure can test and/or recalibrate themselves. Accordingly, fire sensing devices in accordance with the present disclosure may take significantly less maintenance time to test to determine whether maintenance or recalibration is required, can be tested and/or recalibrated continuously and/or on demand, and can more accurately determine the ability of the fire sensing device to detect an actual fire. As such, self-testing fire sensing devices may have extended service lives and be replaced less often resulting in a positive environmental impact.

Further, the fire sensing devices in accordance with the present disclosure can perform their self-testing and/or recalibration without utilizing a liquid or wax reservoir (e.g., bath) to generate the aerosol and/or carbon monoxide used for the test. Rather, the fire sensing devices in accordance with the present disclosure can perform their self-testing and/or recalibration by utilizing a wire (e.g., a coiled wire) that has been dipped in (e.g., coated with) a wax or other material, or a coiled wire that wraps around a wax or other material included (e.g., stored) in a high temperature wick, to generate the aerosol and/or carbon monoxide. Such a wire may have any orientation within the fire sensing device, thereby allowing the device to placed (e.g., mounted) in any orientation without the wax leaking or spilling. In contrast, the reservoir (e.g., bath) must be oriented horizontally within the fire sensing device so that the liquid or wax does not leak or spill from bath, thereby limiting the orientation of the device. Further, the liquid or wax in the bath may be susceptible to spills (e.g. due to high temperatures) during storage or shipping of the device, and/or during operation of the device.

Further, a fire sensing device in accordance with the present disclosure can generate a more controllable level of aerosol and/or carbon monoxide than fire sensing devices that utilize a bath, and therefore can perform a more realistic (e.g., accurate) test. Further, a fire sensing device in accordance with the present disclosure can conduct repeated tests over the lifetime of the device. For instance, a fire sensing device in accordance with the present disclosure can generate enough aerosol and/or carbon monoxide to perform hundreds, or even thousands, of tests.

In the following detailed description, reference is made to the accompanying drawings that form a part hereof. The drawings show by way of illustration how one or more embodiments of the disclosure may be practiced.

These embodiments are described in sufficient detail to enable those of ordinary skill in the art to practice one or more embodiments of this disclosure. It is to be understood that other embodiments may be utilized and that mechanical, electrical, and/or process changes may be made without departing from the scope of the present disclosure.

As will be appreciated, elements shown in the various embodiments herein can be added, exchanged, combined, and/or eliminated so as to provide a number of additional embodiments of the present disclosure. The proportion and the relative scale of the elements provided in the figures are intended to illustrate the embodiments of the present disclosure and should not be taken in a limiting sense.

The figures herein follow a numbering convention in which the first digit or digits correspond to the drawing figure number and the remaining digits identify an element or component in the drawing. Similar elements or components between different figures may be identified by the use of similar digits. For example, 132 may reference element "32" in FIGS. 1A-1B, and a similar element may be referenced as 232 in FIGS. 2A-2B.

As used herein, "a", "an", or "a number of" something can refer to one or more such things, while "a plurality of" something can refer to more than one such things. For example, "a number of components" can refer to one or more components, while "a plurality of components" can refer to more than one component.

Figure 1B:
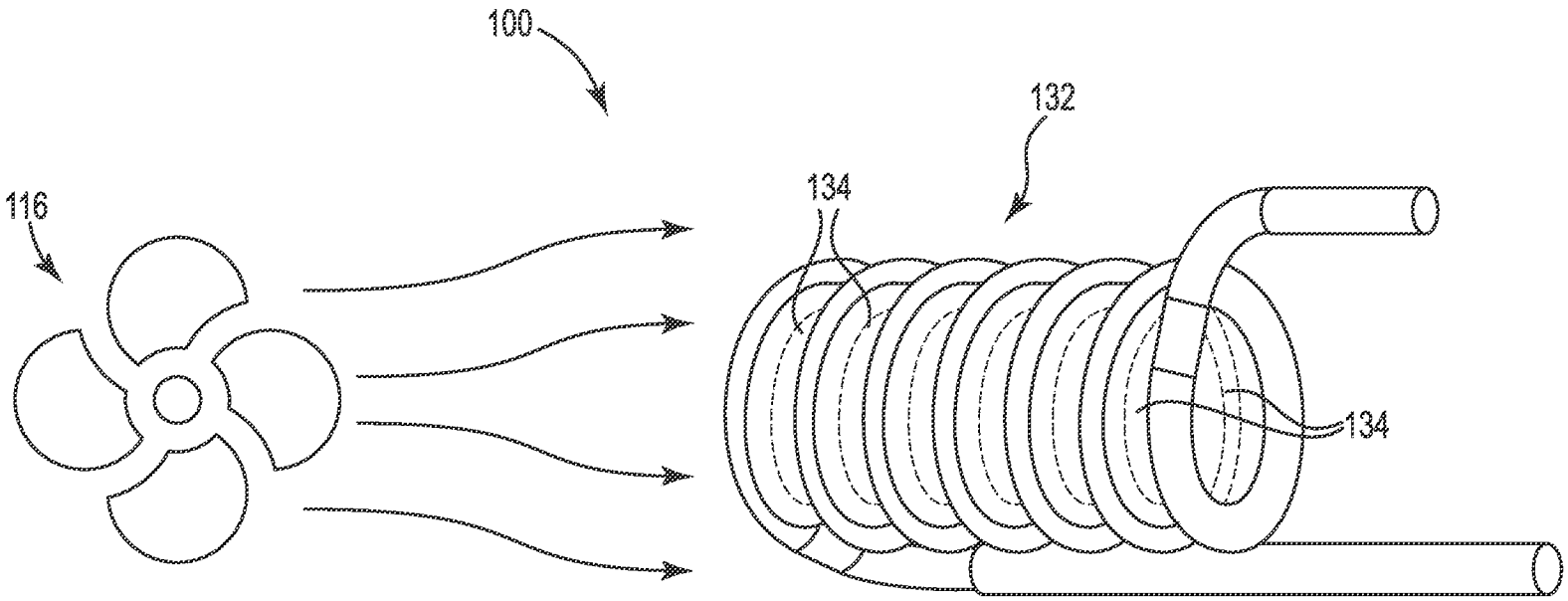

FIGS. 1A-1B illustrate a portion of a self-testing hazard sensing device 100 in accordance with an embodiment of the present disclosure. As used herein, the term "hazard sensing device" may include and/or refer to, for instance, a fire and/or carbon monoxide sensing device.

As shown in FIGS. 1A-1B, hazard (e.g., fire) sensing device 100 can include an airflow generator (e.g., variable airflow generator) 116 and a wire 132. Wire 132 can be included in a gas and/or smoke generator of the fire sensing device 100, as will be further described herein.

In the example illustrated in FIG. 1A, wire 132 is oriented vertically with respect to airflow generator 116. In the example illustrated in FIG. 1B, wire 132 is oriented horizontally with respect to airflow generator 116. However, embodiments of the present disclosure are not limited to a particular orientation for wire 132.

Airflow generator 116 can be, for example, a fan, as illustrated in FIGS. 1A-1B. Further, wire 132 can be shaped to generate aerosol and/or carbon monoxide, as will be further described herein. For instance, wire 132 can be a coiled (e.g., coil-shaped) wire, as illustrated in FIGS. 1A-1B. Wire 132 can be, for instance, a resistance wire having an iron-chromium-aluminum (FeCrAl) alloy. However, embodiments of the present disclosure are not limited to a particular type of airflow generator, or to a particular type or shape of wire.

As shown in FIGS. 1A-1B, wire 132 has been dipped in (e.g., coated with) a material 134, such that material 134 is in direct contact with wire 132. For instance, material 134 is in direct contact with and between the coils of wire 132, as illustrated in FIGS. 1A-1B.

Material 134 can be a solid material at room temperature that has a melting point of 70 degrees Celsius or greater. For instance, material 134 can be a wax material, such as a paraffin wax material.

Wire 132 may be dipped in material 134 before being installed in fire sensing device 100. For example, wire 132 (e.g., the entire wire) may be dipped in a reservoir (e.g., bath) of material 134 while the material is in liquid form. For instance, wire 132 may be dipped in the reservoir of material 134 for two seconds. Wire 132 may then be removed from the reservoir, such that material 134 hardens and remains in contact with (e.g., sticks to) wire 132 (e.g., between the coils of the wire). After wire 132 has been removed from the reservoir and material 134 has hardened, wire 132 can be installed in fire sensing device 100.

During a self-test function being performed by fire sensing device 100, a current can be provided to wire 132. For instance, the current can be provided to wire 132 by a controller of fire sensing device 100, which will be further described herein. The current can be provided to wire 132 at a particular time interval during the self-test function, such as, for instance, every 15 seconds. However, embodiments of the present disclosure are not limited to such a time interval. Further, a current can be provided (e.g., by the controller) to airflow generator 116 during the self-test function (e.g., at the particular time interval).

In some embodiments, the current can be provided to wire 132 and/or airflow generator 116 using an internal power supply of fire sensing device 100, such as, for instance, a battery. In some embodiments, the current can be provided to wire 132 and/or airflow generator 116 using an external power supply of fire sensing device 100, such as, for instance, the wiring and/or power supply of the facility in which the device is installed. The power supply can be, for instance, a 3.5 Watt power supply. However, embodiments of the present disclosure are not limited to a particular type or amount of power supply.

Providing the current to wire 132 can heat the wire, which in turn can heat material 134 and generate aerosol and/or carbon monoxide (CO). For example, the current flowing through wire 132 can be used to control the temperature of material 134 and accordingly control the number of particles generated by material 134. For instance, wire 132 can heat material 134 to create airborne particles to simulate smoke from a fire. The particles can measure approximately 1 micrometer in diameter and/or the particles can be within the sensitivity range of a sensor, such as an optical scatter chamber, of fire sensing device 100, which will be further described herein. The wire 132 can heat material 134 to a particular temperature and/or heat material 134 for a particular period of time to generate an aerosol density level sufficient to trigger a fire response from a properly functioning fire sensing device without saturating the sensor and/or generate an aerosol density level sufficient to test a fault condition without triggering a fire response or saturating the sensor. The ability to control the aerosol density level can allow a smoke test to more accurately mimic the characteristics of a fire and prevent the sensor from becoming saturated.

Airflow generator 116 can provide the aerosol and/or CO to (e.g., move the aerosol and/or CO through) a sensor, such as an optical scatter chamber of fire sensing device 100, which will be further described herein. For instance, in embodiments in which airflow generator 116 is a fan, the fan can direct (e.g., blow) the aerosol and/or CO into the sensor, as represented by the arrows illustrated in FIGS. 1A-1B. Airflow generator 116 can operate to provide the aerosol and/or CO to the sensor using the current provided to thereto. As an additional example, the current can be provided to airflow generator 116 at a particular interval to detect and/or prevent dust cover in fire sensing device 100.

The aerosol and/or CO provided to the sensor can be used to determine (e.g., test) whether the fire sensing device 100 is functioning properly (e.g., whether the device requires maintenance and/or recalibration). This determination can made by, for instance, the controller of fire sensing device 100, or by monitoring device that is in communication with fire sensing device 100, as will be further described herein.

As an example, the rate at which the density level of the aerosol provided to the sensor decreases can be measured.

An airflow rate from an external environment through the optical sensor can be determined based on the measured rate at which the density level of the aerosol decreases, and the determination of whether the fire sensing device 100 is functioning properly can be made based on this determined airflow rate. Additionally or alternatively, the measured rate at which the density level of the aerosol decreases can be compared with a baseline rate, and the determination of whether the fire sensing device 100 is functioning properly can be made based on the comparison. Such testing of fire sensing device 100 will be further described herein.

As an additional example, a first transmitter light-emitting diode (LED) of fire sensing device 100 can emit a first light that passes through the aerosol provided to the sensor, and a second transmitter LED of fire sensing device 100 can emit a second light that passes through the aerosol provided to the sensor. A photodiode of the fire sending device 100 can detect the scatter level of the first light that passes through the aerosol and the scatter level of the second light that passes through the aerosol, and the determining of whether fire sensing device 100 is functioning properly can be made based on the detected scatter level of the first light and/or the detected scatter level of the second light. Such testing of fire sensing device 100 will be further described herein.

Figure 2A:
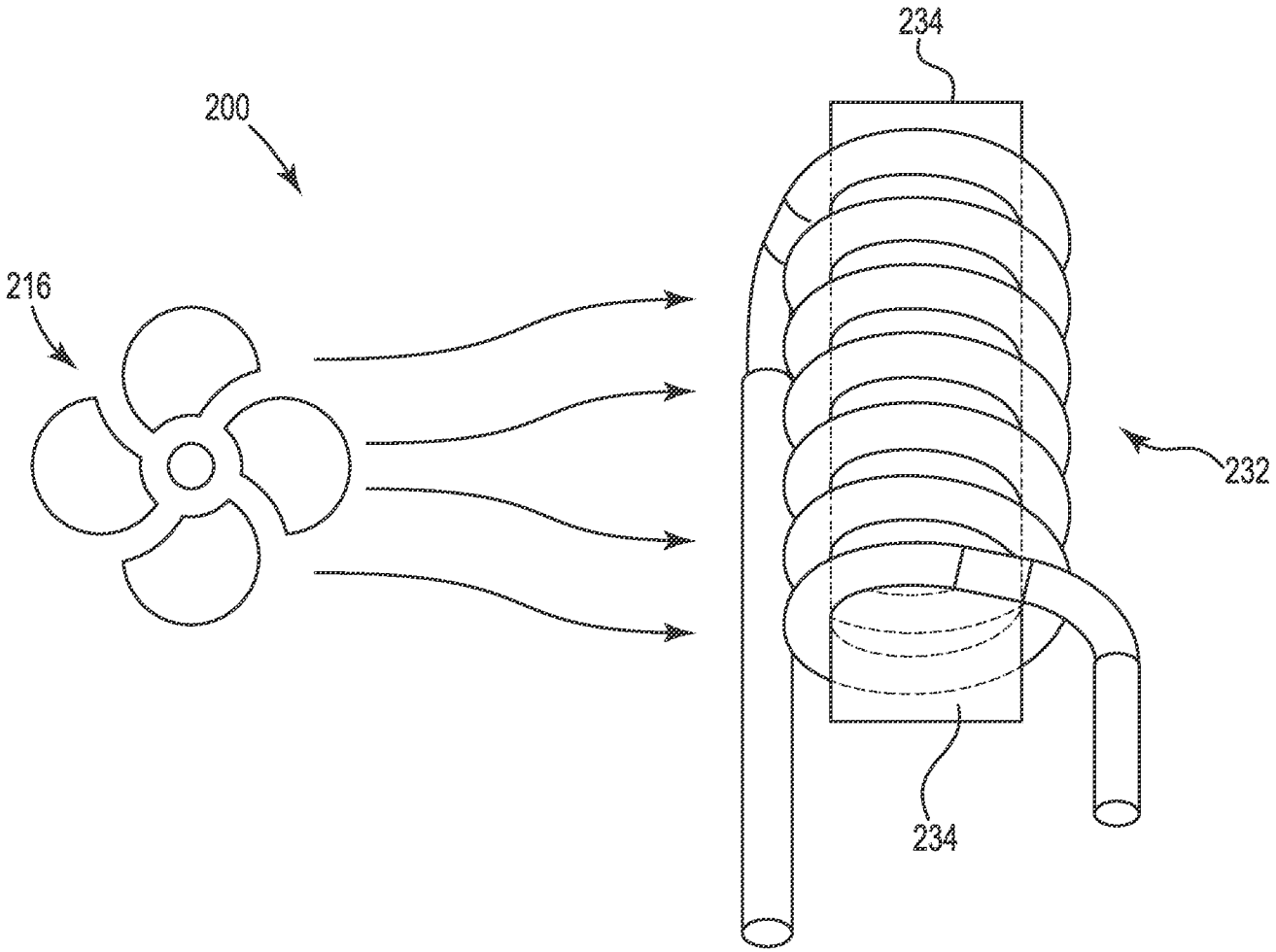
FIGS. 2A-2B illustrate a portion of a self-testing hazard sensing device in accordance with an embodiment of the present disclosure.
Figure 2B:
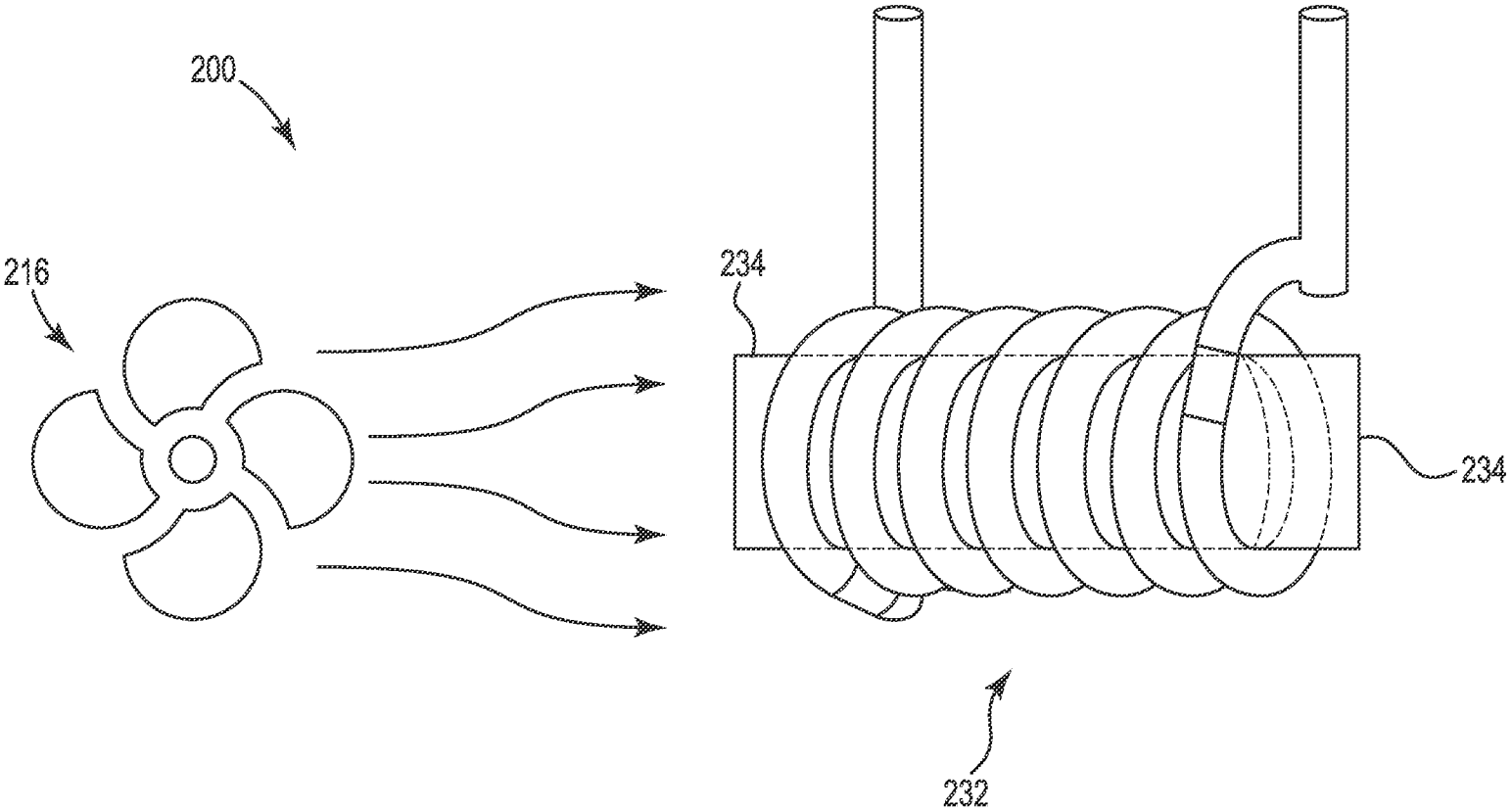

FIGS. 2A-2B illustrate a portion of a self-testing hazard (e.g., fire) sensing device 200 in accordance with an embodiment of the present disclosure. As shown in FIGS. 2A-2B, fire sensing device 200 can include an airflow generator (e.g. variable airflow generator) 216 and a wire 232. In the example illustrated in FIG. 2A, wire 232 is oriented vertically with respect to airflow generator 216. In the example illustrated in FIG. 2B, wire 232 is oriented horizontally with respect to airflow generator 216. However, embodiments of the present disclosure are not limited to a particular orientation for wire 232. Airflow generator 216 and wire 232 can be analogous to airflow generator 116 and wire 132, respectively, previously described in connection with FIGS. 1A-1B.

As shown in FIGS. 2A-2B, wire 232 (e.g., the coils of wire 232) can wrap around a material 234. Material 234 can be analogous to material 134 previously described in connection with FIGS. 1A-1B. However, in the examples illustrated in FIGS. 2A-2B, material 234 is included (e.g., contained or stored) in a high-temperature wick material, around which wire 232 is wrapped before being installed in fire sensing device 200.

For example, the high-temperature wick material can be dipped in a reservoir (e.g., bath) of material 234 while the material is in liquid form. The wick material may then be removed from the reservoir, such that material 234 hardens in the wick. After the wick material has been removed from the reservoir and material 234 has hardened, wire 232 can be wrapped around the wick (e.g., such that the wick material is in contact with wire 232) and installed in fire sensing device 200.

During a self-test function being performed by fire sensing device 200, a current can be provided to wire 232, in a manner analogous to that previously described for wire 132 in connection with FIG. 1. Providing the current to wire 232 can heat the wire, which in turn can heat material 234 and generate aerosol and/or CO, in a manner analogous to that previously described in connection with FIG. 1.

Airflow generator 216 can provide the aerosol and/or CO to (e.g., move the aerosol and/or CO through) a sensor, such as an optical scatter chamber of fire sensing device 200, in a manner analogous to that previously described for airflow generator 116 in connection with FIG. 1. The aerosol and/or CO provided to the sensor can be used to determine (e.g., test) whether the fire sensing device 200 is functioning properly (e.g., whether the device requires maintenance and/or recalibration), in a manner analogous to that previously described for fire sensing device 100 in connection with FIG. 1.

Figure 3:
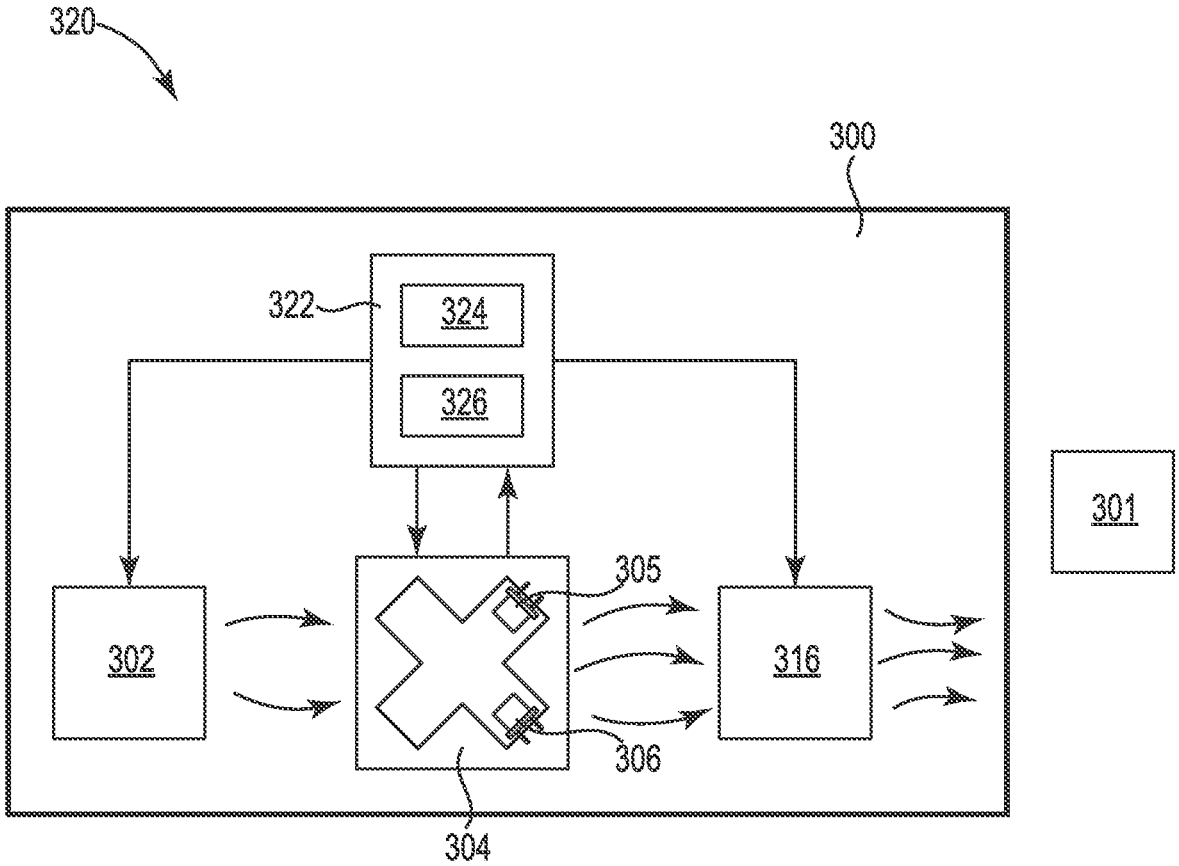
FIG. 3 illustrates a block diagram of a self-test function of a hazard sensing device in accordance with an embodiment of the present disclosure.

FIG. 3 illustrates a block diagram of a self-test function 320 (e.g., smoke self-test function) of a hazard (e.g., fire) sensing device in accordance with an embodiment of the present disclosure. The block diagram of the self-test function 320 includes a fire sensing device 300 and a monitoring device 301. The fire sensing device 300 includes a controller (e.g., microcontroller) 322, a gas and/or smoke generator 302, a sensor 304, and an airflow generator (e.g., variable airflow generator) 316.

Sensor 304 can be a smoke (e.g., particulate) sensor, a carbon monoxide (CO) sensor, or a combination thereof. For example, sensor 304 can be an optical sensor such as optical scatter chamber, a gas sensor, or an ionization sensor, among other types of sensors.

The monitoring device 301 can be a control panel, a fire detection control system, and/or a cloud computing device of a fire alarm system. The monitoring device 301 can be configured to send commands to and/or receive test results from a fire sensing device 300 via a wired or wireless network. The network can be a network relationship through which monitoring device 301 can communicate with the fire sensing device 300. Examples of such a network relationship can include a distributed computing environment (e.g., a cloud computing environment), a wide area network (WAN) such as the Internet, a local area network (LAN), a personal area network (PAN), a campus area network (CAN), or metropolitan area network (MAN), among other types of network relationships. For instance, the network can include a number of servers that receive information from, and transmit information to, monitoring device 301 and the fire sensing device 300 via a wired or wireless network.

As used herein, a "network" can provide a communication system that directly or indirectly links two or more computers and/or peripheral devices and allows a monitoring device to access data and/or resources on a fire sensing device 300 and vice versa. A network can allow users to share resources on their own systems with other network users and to access information on centrally located systems or on systems that are located at remote locations. For example, a network can tie a number of computing devices together to form a distributed control network (e.g., cloud).

A network may provide connections to the Internet and/or to the networks of other entities (e.g., organizations, institutions, etc.). Users may interact with network-enabled software applications to make a network request, such as to get data. Applications may also communicate with network management software, which can interact with network hardware to transmit information between devices on the network.

The microcontroller 322 can include a memory 324 and a processor 326. Memory 324 can be any type of storage medium that can be accessed by processor 326 to perform various examples of the present disclosure. For example, memory 324 can be a non-transitory computer readable medium having computer readable instructions (e.g., computer program instructions) stored thereon that are executable by processor 326 to test a fire sensing device 300 in accordance with the present disclosure. For instance, processor 326 can execute the executable instructions stored in memory 324 to generate a particular aerosol density level, measure the generated aerosol density level, determine an airflow rate from an external environment through the sensor 304, and transmit the determined airflow rate. In some examples, memory 324 can store the aerosol density level sufficient to trigger a fire response from a properly firing sensing device, the aerosol density level sufficient to test a fault condition without triggering a fire response, the threshold airflow rate to verify proper airflow through the sensor 304, and/or the particular period of time that has passed since previously conducting a smoke self-test function (e.g., generating a particular aerosol density level and measuring the generated aerosol density level).

As an additional example, processor 326 can execute the executable instructions stored in memory 324 to generate an aerosol density level, measure a rate at which the aerosol density level decreases after the aerosol density level has been generated, compare the measured rate at which the aerosol density level decreases with a baseline rate, and determine whether the fire sensing device 300 is functioning properly (e.g., requires maintenance) based on the comparison of the measured rate and the baseline rate. In some examples, memory 324 can store the baseline rate and/or the measured rate.

The microcontroller 322 can execute the smoke self-test function 320 of the fire sensing device 300 responsive to a particular period of time passing since previously conducting a smoke self-test function and/or responsive to receiving a command from the monitoring device 301. For example, the microcontroller 322 can provide a current to a wire of the gas and/or smoke generator 302 to generate aerosol, as previously described herein. The aerosol can be drawn through the sensor 304 via the airflow generator (e.g., fan) 316 creating a controlled aerosol density level. The aerosol density level can be sufficient to trigger a fire response without saturating a sensor. The aerosol density level can be measured and the airflow rate can be determined by the sensor 304. For instance, the aerosol density level can be measured a number of times over a time period, and the rate at which the aerosol density level decreases can be determined based on the measurements of the aerosol density level over the time period. As shown in FIG. 3, the sensor 304 can include a transmitter light-emitting diode (LED) 305 and a receiver photodiode 306 to measure the aerosol density level.

Once the aerosol density level is measured and/or the airflow rate is determined, the fire sensing device 300 can store the test result (e.g., fire response, aerosol density level, rate at which the aerosol density level decreases after the aerosol density level has been generated, and/or airflow rate) in memory 324 and/or send the test result to the monitoring device 301. Further, the measured rate at which the aerosol density level decreases can be stored in memory 324 as a baseline rate if, for example, the measured rate is the first (e.g., initial) measured rate at which the aerosol density level decreases in the fire sensing device 300. If the fire sensing device 300 already has a baseline rate, then the measured rate can be stored in memory 324 as a subsequently measured rate at which the aerosol density level decreases.

In some examples, the fire sensing device 300 (e.g., controller 322) can determine whether the fire sensing device 300 is functioning properly based on the test result and/or the monitoring device 301 can determine whether the fire sensing device 300 is functioning properly based on the test result. For example, the monitoring device 301 can determine the fire sensing device 300 is functioning properly responsive to the triggering of a fire response and/or the airflow rate exceeding a threshold airflow rate.

In some examples, the fire sensing device 300 (e.g., controller 322) and/or monitoring device 301 can determine whether the fire sensing device 300 is functioning properly (e.g., requires maintenance) by comparing the subsequently measured rate at which the aerosol density level decreases with the baseline rate. For example, the fire sensing device 300 may require maintenance when the difference between the measured rate and the baseline rate is greater than a threshold value. The threshold value can be set by a manufacturer, according to regulations, and/or set based on the baseline rate, for example.

As an additional example, processor 326 can execute the executable instructions stored in memory 324 to generate aerosol having a controllable density level, emit a first light that passes through the aerosol, emit a second light that passes through the aerosol, detect a scatter level of the first light that passes through the aerosol, detect a scatter level of the second light that passes through the aerosol, and calibrate a gain of a photodiode based on the detected scatter level of the first light, the detected scatter level of the second light, and the controllable aerosol density level. In some examples, memory 324 can store the detected scatter level of the first light and/or the detected scatter level of the second light.

For example, the microcontroller 322 can provide a current to a wire of the gas and/or smoke generator 302 to generate aerosol, as previously described herein. The aerosol can be drawn through the sensor 304 via the airflow generator (e.g., fan) 316 creating a controlled aerosol density level. The sensor 304 can include an additional transmitter LED (not shown in FIG. 3) opposite photodiode 306, and an additional photodiode (not shown in FIG. 3) opposite transmitter LED 305, and transmitter LED 305, photodiode 306, the additional transmitter LED, and the additional photodiode can measure the aerosol density level by detecting scatter levels. Scatter can be light from the transmitter LEDs reflecting, refracting, and/or diffracting off of particles and can be received by the photodiodes. The amount of light received by the photodiodes can be used to determine the aerosol density level. For instance, transmitter LED 305 can emit a first light and the additional transmitter LED can emit a second light. The additional photodiode can detect a scatter level of the first light and/or the second light and photodiode 306 can detect a scatter level of the first light and/or the second light.

In a number of embodiments, a fault (e.g., an error) can be triggered responsive to the detected scatter level. For example, the controller 322 can compare the detected scatter level to a threshold scatter level and trigger a fault responsive to the detected scatter level being below the threshold scatter level. Another example can include the controller 322 comparing the detected scatter level to a previously detected scatter level and triggering a fault responsive to the detected scatter level being less than the previously detected scatter level.

Each amplifier gain can be calibrated by storing the initial detected scatter level and each amplifier gain in memory 324. Over time LED emission levels of the transmitter LEDs can decrease, reducing the received light by the photodiodes, which could lead to the fire sensing device 300 malfunctioning.

The amplifier gain used by the photodiodes for detecting scatter levels can be recalibrated as the transmitter LEDs degrade over time. Controller 322 can recalibrate the gain responsive to the detected scatter level. For example, the controller 322 can initiate a recalibration of the gain responsive to comparing the detected scatter level to a threshold scatter level and determining the detected scatter level is below the threshold scatter level. In some examples, the controller 322 can recalibrate the gain responsive to determining a difference between the detected scatter level and the initial detected scatter level is greater than a threshold value and/or responsive to determining the detected scatter level is less than a previously detected scatter level.

Figure 4:
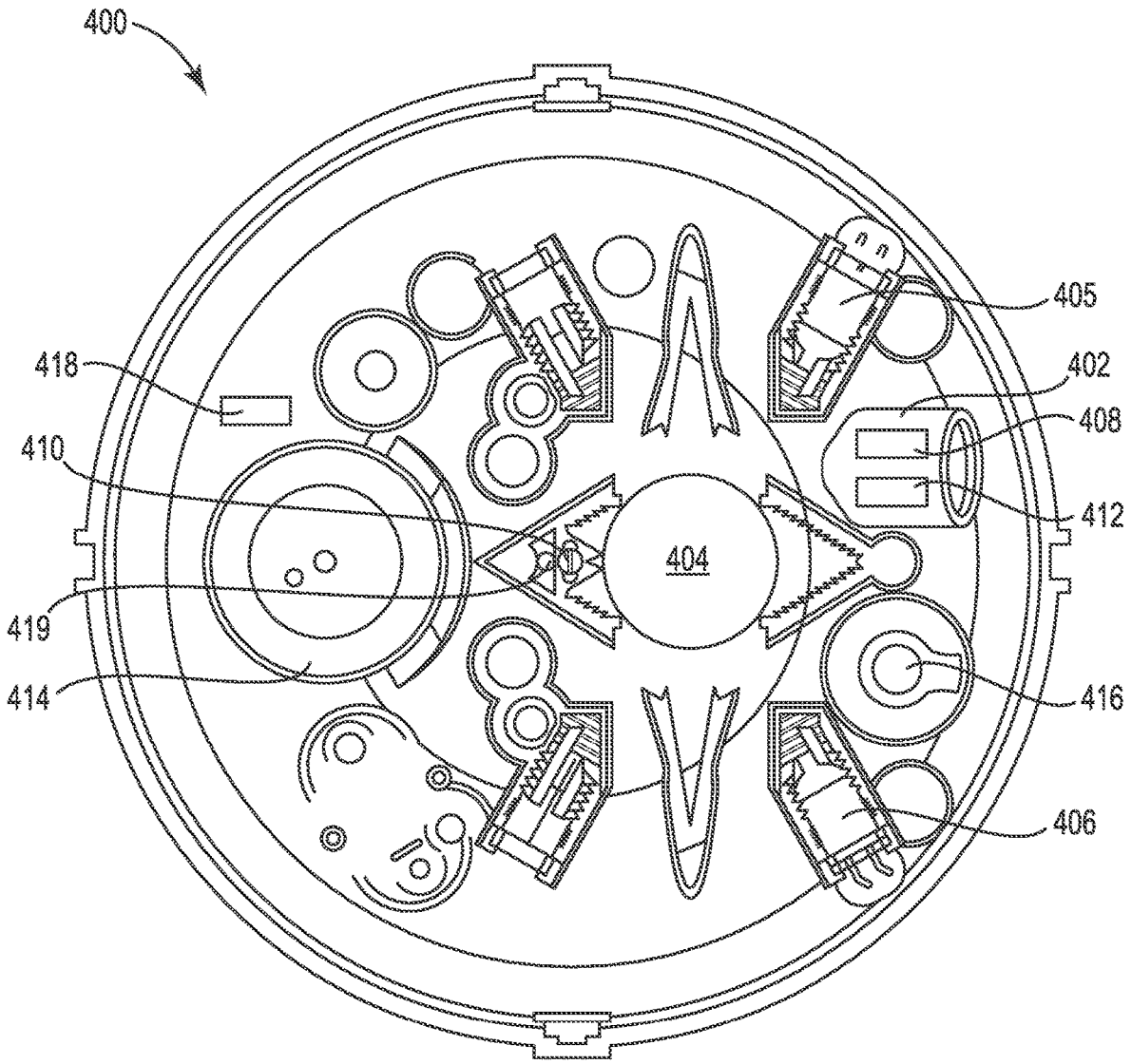
FIG. 4 illustrates an example of a self-testing hazard sensing device in accordance with an embodiment of the present disclosure.

FIG. 4 illustrates an example of a self-testing hazard (e.g., fire) sensing device 400 in accordance with an embodiment of the present disclosure. The self-testing fire sensing device 400 can be, but is not limited to, a fire and/or smoke detector of a fire control system.

A fire sensing device 400 (e.g., smoke detector) can sense a fire occurring in a facility and trigger a fire response to provide a notification of the fire to occupants of the facility. A fire response can include visual and/or audio alarms, for example. A fire response can also notify emergency services (e.g., fire departments, police departments, etc.) In some examples, a plurality of fire sensing devices can be located throughout a facility (e.g., on different floors and/or in different rooms of the facility).

A self-testing fire sensing device 400 can automatically or upon command conduct one or more tests contained within the fire sensing device 400. The one or more tests can determine whether the self-testing fire sensing device 400 is functioning properly, as previously described herein.

As shown in FIG. 4, fire sensing device 400 can include a gas and/or smoke generator 402, a sensor 404 including a transmitter light-emitting diode (LED) 405 and a receiver photodiode 406, a heat source 408, a heat sensor 410, a gas source 412, a gas sensor 414, an airflow generator (e.g., variable airflow generator) 416, a proximity sensor 418, and an additional heat source 419. In some examples, a fire sensing device 400 can also include a microcontroller including memory and/or a processor, and/or an additional transmitter LED and receiver photodiode, as previously described herein (e.g., in connection with FIG. 3).

Sensor 404 can be a smoke (e.g., particulate) sensor, a carbon monoxide (CO) sensor, or a combination thereof. For example, sensor 404 can be an optical sensor such as optical scatter chamber, a gas sensor, or an ionization sensor, among other types of sensors.

The gas and/or smoke generator 402 of the fire sensing device 400 can generate aerosol which can be mixed into a controlled aerosol density level by the airflow generator 416, as previously described herein. The aerosol density level can be a particular level that can be detected by sensor 404. Once the aerosol density level has reached the particular level, the gas and/or smoke generator 402 can be turned off and the airflow generator 416 can increase the rate of airflow through the sensor 404. The airflow generator 416 can increase the rate of airflow through the sensor 404 to reduce the aerosol density level back to an initial level of the sensor 404 prior to the gas and/or smoke generator 402 generating aerosol. For example, the airflow generator 416 can remove the aerosol from the sensor 404 after it is determined whether the fire sensing device 400 is functioning properly (e.g., after the rate in reduction of aerosol density is determined or after the scatter levels described herein are detected). If the fire sensing device 400 is not blocked or covered, then airflow from the external environment through the sensor 404 will cause the aerosol density level to decrease. The rate at which the aerosol density level decreases after the aerosol density level has been generated is proportional to airflow from the external environment through the sensor 404, so the sensor 404 can measure the airflow to determine whether the sensing device 400 is impeded and whether the sensing device 400 is functioning properly.

The gas and/or smoke generator 402 can include a wire 408 dipped in or wrapped around a material (e.g., wax) having a melting point of 70 degrees Celsius or greater, as previously described herein. A current flowing through the wire can be used to heat the material and generate aerosol, as previously described herein. For instance, the current can heat the material to create airborne particles to simulate smoke from a fire. The particles can measure approximately 1 micrometer in diameter and/or the particles can be within the sensitivity range of the sensor 404. The current flowing through wire 408 can heat the material to a particular temperature and/or for a particular period of time to generate an aerosol density level sufficient to trigger a fire response from a properly functioning fire sensing device without saturating the sensor 404 and/or generate an aerosol density level sufficient to test a fault condition without triggering a fire response or saturating the sensor 404. The ability to control the aerosol density level can allow a smoke test to more accurately mimic the characteristics of a fire and prevent the sensor 404 from becoming saturated.

The sensor 404 can sense the external environment due to a baffle opening in the fire sensing device 400 that allows air and/or smoke from a fire to flow through the fire sensing device 400. The sensor 404 can be an example of an airflow monitoring device, and can measure the aerosol density level. In some examples a different airflow monitoring device can be used to measure the airflow through the fire sensing device 400.

As previously discussed, the rate of reduction in aerosol density level can be used to determine an airflow rate from the external environment through the sensor 404, and a determination of whether fire sensing device 400 is functioning properly can be made based on the determined air flow rate and/or the fire response. For example, the fire sensing device 400 can be determined to be functioning properly responsive to the airflow rate exceeding a threshold airflow rate and/or a fire response being triggered. As an additional example, the fire sensing device can be determined to require maintenance responsive to a difference between the measured airflow rate and a baseline rate being greater than a threshold value.

In some examples, the fire sensing device 400 can trigger a fault if the airflow rate fails to exceed a threshold airflow rate. For example, the fire sensing device 400 can send a notification of the fault to a monitoring device when an impeded airflow is detected. In some examples, the impeded airflow can be caused by a person deliberately attempting to mask (e.g., cover) the fire sensing device 400.

Further, as previously discussed, the detected scatter levels from the test can be used to determine whether fire sensing device 400 requires maintenance and/or recalibration. For example, the fire sensing device 400 can be determined to require maintenance and/or recalibration responsive to a calculated sensitivity, calculated using the detected scatter level and the known aerosol density level, being outside a sensitivity range.

In some examples, the fire sensing device 400 can generate a message if the device requires maintenance (e.g., if the difference between the measured airflow rate and the baseline rate is greater than the threshold value, or the calculated sensitivity is outside the sensitivity range). The fire sensing device 400 can send the message to a monitoring device and/or a mobile device, for example. As an additional example, the fire sensing device 400 can include a user interface that can display the message.

The fire sensing device 400 of FIG. 4 illustrates transmitter LED 405 and photodiode 406. Transmitter LED 405 can emit a first light and a second light. In some examples, the first light can have a first wavelength and the second light can have a second wavelength. For example, transmitter LED 405 can include an infrared (IR) LED with a first wavelength and a blue LED with a second wavelength. Having two or more different wavelengths can help the fire sensing device 400 detect various types of smoke. For example, a first wavelength can better detect a flaming fire including black aerosol and a second wavelength can better detect water vapor including white non-fire aerosol. In some examples, a ratio of the first wavelength and the second wavelength can be used to indicate the type of smoke. Photodiode 406 can receive a scatter of the first light and/or the second light from transmitter LED 405. Photodiode 406 can detect a scatter level of the first light and/or a scatter level of the second light. In a number of embodiments, photodiode 406 can be a transmitter LED.

In an additional example, the fire sensing device 400 may include an additional transmitter LED opposite transmitter LED 405. Transmitter LED 405 can emit a first light and the additional transmitter LED can emit a second light. Transmitter LED 405 and/or the additional transmitter LED can be located at particular angles from photodiode 406 to detect various types of smoke. For example, transmitter LED 405 can be located approximately 120 degrees from photodiode 406 and the additional transmitter LED can be located approximately 60 degrees from photodiode 406. Photodiode 406 can receive the first light from transmitter LED 405 and/or the second light from the additional transmitter LED, and can detect a scatter level of the first light and/or a scatter level of the second light.

The fire sensing device 400 can include an additional heat source 419, but may not require an additional heat source 419 if the heat sensor 410 is self-heated. In some examples, heat source 419 can generate heat at a temperature sufficient to trigger a fire response from a properly functioning heat sensor 410. The heat source 419 can be turned on to generate heat during a heat self-test. Once the heat self-test is complete, the heat source 419 can be turned off to stop generating heat.

The heat sensor 410 can normally be used to detect a rise in temperature caused by a fire. Once the heat source 419 is turned off, the heat sensor 410 can measure a rate of reduction in temperature. The rate of reduction in temperature can be proportional to the airflow from the external environment through the fire sensing device 400 and as such the rate of reduction in temperature can be used to determine the airflow rate. The airflow rate can be used to determine whether air is able to enter the fire sensing device 400 and reach the heat sensor 410. The airflow rate can also be measured and used to compensate the generation of an aerosol used to self-test the fire sensing device 400. Further, the rate in reduction in temperature can be used to determine whether the fire sensing device 400 is functioning properly (e.g., requires maintenance) and/or whether the fire sensing device 400 is dirty. For instance, the maintenance can include cleaning the fire sensing device 400 so that clean air is able to enter the device and reach the heat sensor 410.

A fire response can be triggered responsive to the heat sensor 410 detecting a temperature exceeding a threshold temperature. The fire sensing device 400 can be determined to be functioning properly responsive to the triggering of the fire response and the determined airflow rate.

A fault can be triggered by the fire sensing device 400 responsive to a determined change in temperature over time failing to exceed a threshold temperature change over time. In some examples, the fault can be sent to a monitoring device. The determined change in temperature over time can determine whether the fire sensing device 400 is functioning properly. In some examples, the fire sensing device 400 can be determined to be functioning properly responsive to an airflow rate derived from the determined change in temperature over time exceeding a threshold airflow rate.

A gas source 412 can be separate and/or included in the gas and/or smoke generator 402, as shown in FIG. 4. The gas source 412 can be configured to release one or more gases. The one or more gases can be produced by combustion. In some examples, the one or more gases can be carbon monoxide (CO) and/or a cross-sensitive gas. The gas source 412 can generate gas at a gas level sufficient to trigger a fire response from a properly functioning fire sensing device and/or trigger a fault in a properly functioning gas sensor 414.

The gas sensor 414 can detect one or more gases in the fire sensing device 400, such as, for example, the one or more gases released by the gas source 412. For example, the gas sensor 414 can detect CO and/or cross-sensitive gases. In some examples, the gas sensor 414 can be a CO detector. Once the gas source 412 is turned off, the gas sensor 414 can measure the gas level and determine the change in gas level over time (e.g., rate of reduction in gas level) to determine the airflow rate. The airflow rate can be used to determine whether air is able to enter the fire sensing device 400 and reach the gas sensor 414, and hence whether fire sensing device 400 is functioning properly and/or is dirty (e.g., requires cleaning).

A fire response of the fire sensing device 400 can be triggered responsive to the gas sensor 414 detecting one or more gases and/or one or more gases exceeding a threshold level. The fire sensing device 400 can be determined to be functioning properly responsive to the fire response, the gas sensor 414 detecting the one or more gases and/or the one or more gases exceeding the threshold level and the fire sensing device 400 properly triggering a fire response.

The fire sensing device 400 can be determined to be functioning properly based on the change in the gas level over time. In some examples, the fire sensing device 400 can be determined to be functioning properly responsive to the change in the gas level over time exceeding a threshold gas level change and/or a threshold airflow rate, derived from the determined change in gas level over time, exceeding a threshold airflow rate. The fire sensing device 400 can trigger and/or send a fault responsive to the change in gas level over time failing to exceed the threshold change in gas level and/or the airflow rate failing to exceed the threshold airflow rate. In some examples, the fire sensing device 400 can be determined to be functioning properly responsive to the triggering of a fire response and/or triggering of a fault.

The airflow generator 416 can control the airflow through the fire sensing device 400, including the sensor 404. For example, the airflow generator 416 can move gases and/or aerosol from a first end of the fire sensing device 400 to a second end of the fire sensing device 400. In some examples, the airflow generator 416 can be a fan. The airflow generator 416 can start responsive to the gas and/or smoke generator 402, the heat source 419, and/or the gas source 412 starting. The airflow generator 416 can stop responsive to the gas and/or smoke generator 402, the heat source 419, and/or the gas source 412 stopping, and/or the airflow generator 416 can stop after a particular period of time after the gas and/or smoke generator 402, the heat source 419, and/or the gas source 412 has stopped.

The fire sensing device 400 can include one or more proximity sensors 418. A proximity sensor 418 can detect objects within a particular distance of the fire sensing device 400, and therefore can be used to detect tampering intended to prevent fire sensing device 400 from functioning properly. For example, the proximity sensor 418 can detect an object (e.g., a hand, a piece of clothing, etc.) placed in front of or on the fire sensing device 400 to impede heat, gas, and/or smoke from entering the sensor 404 in an attempt to prevent the triggering of a fire response from the fire sensing device 400. In some examples, a fire response of the fire sensing device 400 can be triggered responsive to the proximity sensor 418 detecting an object within a particular distance of the fire sensing device 400.

Although specific embodiments have been illustrated and described herein, those of ordinary skill in the art will appreciate that any arrangement calculated to achieve the same techniques can be substituted for the specific embodiments shown. This disclosure is intended to cover any and all adaptations or variations of various embodiments of the disclosure.

It is to be understood that the above description has been made in an illustrative fashion, and not a restrictive one. Combination of the above embodiments, and other embodiments not specifically described herein will be apparent to those of skill in the art upon reviewing the above description.

The scope of the various embodiments of the disclosure includes any other applications in which the above structures and methods are used. Therefore, the scope of various embodiments of the disclosure should be determined with reference to the appended claims, along with the full range of equivalents to which such claims are entitled.

In the foregoing Detailed Description, various features are grouped together in example embodiments illustrated in the figures for the purpose of streamlining the disclosure. This method of disclosure is not to be interpreted as reflecting an intention that the embodiments of the disclosure require more features than are expressly recited in each claim.

Rather, as the following claims reflect, inventive subject matter lies in less than all features of a single disclosed embodiment. Thus, the following claims are hereby incorporated into the Detailed Description, with each claim standing on its own as a separate embodiment.

What is claimed is:

1. A self-testing hazard sensing device, comprising:
- a sensor;
- a heating element having a material applied thereto;
- a controller configured to provide a current to the heating element to heat the material and generate aerosol and/or carbon monoxide; and
- an airflow generator configured to provide the aerosol and/or carbon monoxide to the sensor;
- wherein the controller is configured to determine whether the self-testing hazard sensing device is functioning properly using the aerosol and/or carbon monoxide provided to the sensor.

2. The self-testing hazard sensing device of claim 1, wherein the heating element is a coil-shaped wire.

3. The self-testing hazard sensing device of claim 1, wherein the heating element is shaped to generate the aerosol and/or carbon monoxide.

4. The self-testing hazard sensing device of claim 1, wherein the material is a wax material.

5. The self-testing hazard sensing device of claim 1, wherein the airflow generator is a fan.

6. The self-testing hazard sensing device of claim 1, wherein the controller is configured to provide the current to the heating element for a particular time interval.

7. The self-testing hazard sensing device of claim 1, wherein the controller is configured to provide a current to the airflow generator for a particular time interval.

8. The self-testing hazard sensing device of claim 1, wherein the controller is configured to determine whether the self-testing hazard sensing device is functioning properly by:
- measuring a rate at which a density level of the aerosol provided to the sensor decreases;
- determining an airflow rate from an external environment through the sensor based on the measured rate at which the density level of the aerosol decreases; and
- determining whether the self-testing hazard sensing device is functioning properly based on the determined airflow rate.

9. The self-testing hazard sensing device of claim 1, wherein the controller is configured to determine whether the self-testing hazard sensing device is functioning properly by:
- measuring a rate at which a density level of the aerosol provided to the sensor decreases;
- comparing the measured rate at which the density level of the aerosol decreases with a baseline rate; and
- determining whether the self-testing hazard sensing device is functioning properly based on the comparison of the measured rate at which the density level of the aerosol decreases and the baseline rate.

10. A method of operating a self-testing hazard sensing device, comprising:
- providing a current to a heating element of the self-testing hazard sensing device, wherein:
  - the heating element has a material applied thereto; and
  - providing the current to the heating element heats the material and generates aerosol and/or carbon monoxide;
- providing the aerosol and/or carbon monoxide to a sensor of the self-testing hazard sensing device; and
- determining whether the self-testing hazard sensing device is functioning properly using the aerosol and/or carbon monoxide provided to the sensor.

11. The method of claim 10, wherein the method includes providing the current to the heating element using an internal power supply of the self-testing hazard sensing device or an external power supply of the self-testing hazard sensing device.

12. The method of claim 10, wherein the method includes:
- applying the material to the heating element by dipping the heating element in the material;
- removing the heating element from the material; and
- installing the heating element in the self-testing hazard sensing device after removing the heating element from the material.

13. The method of claim 10, wherein determining whether the self-testing hazard sensing device is functioning properly includes determining whether the self-testing hazard sensing device requires maintenance or recalibration.

14. The method of claim 10, wherein the method includes determining whether the self-testing hazard sensing device is functioning properly by a monitoring device that is in communication with the self-testing hazard sensing device.

15. The method of claim 10, wherein the method includes determining whether the self-testing hazard sensing device is functioning properly by:

emitting, by a first transmitter light-emitting diode (LED) of the self-testing hazard sensing device, a first light that passes through the aerosol provided to the sensor;

emitting, by a second transmitter LED of the self-testing hazard sensing device, a second light that passes through the aerosol provided to the sensor;

detecting, by a photodiode of the self-calibrating hazard sensing device, a scatter level of the first light that passes through the aerosol and a scatter level of the second light that passes through the aerosol; and determining whether the self-testing hazard sensing device is functioning properly based on the detected scatter level of the first light and/or the detected scatter level of the second light.

16. A self-testing hazard sensing device, comprising:

a sensor;

a coiled wire having a wax material applied thereto;

a controller configured to provide a current to the coiled wire to heat the wax material and generate aerosol and/or carbon monoxide; and an airflow generator configured to provide the aerosol and/or carbon monoxide to the sensor;

wherein the controller is configured to determine whether the self-testing hazard sensing device is functioning properly using the aerosol and/or carbon monoxide provided to the sensor.

17. The self-testing hazard sensing device of claim 16, wherein the wax material is a paraffin wax material.

18. The self-testing hazard sensing device of claim 16, wherein the wax material is in direct contact with and between coils of the coiled wire.

19. The self-testing hazard sensing device of claim 16, wherein the coiled wire is oriented horizontally with respect to the airflow generator or vertically with respect to the airflow generator.

20. The self-testing hazard sensing device of claim 16, wherein the coiled wire is a resistance wire comprising an iron-chromium-aluminum alloy.

* * * * *